US008534476B2

(12) United States Patent
Brozell

(10) Patent No.: US 8,534,476 B2
(45) Date of Patent: Sep. 17, 2013

(54) CHILD-RESISTANT CLOSURE SHELL, CLOSURE, AND PACKAGE

(75) Inventor: Brian John Brozell, Maumee, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 583 days.

(21) Appl. No.: 12/636,070

(22) Filed: Dec. 11, 2009

(65) Prior Publication Data

US 2011/0139742 A1 Jun. 16, 2011

(51) Int. Cl.
*B65D 55/02* (2006.01)

(52) U.S. Cl.
USPC ..... 215/220; 215/217

(58) Field of Classification Search
USPC ..... 215/220, 217, 219; 220/782
See application file for complete search history.

(56) References Cited

U.S. PATENT DOCUMENTS

| | | | | |
|---|---|---|---|---|
| 3,048,317 | A | 8/1962 | Cochrane et al. | |
| 3,055,524 | A | 9/1962 | Glasbrenner | |
| 3,817,416 | A * | 6/1974 | Costa | 215/213 |
| 3,863,796 | A | 2/1975 | Roy | |
| 3,878,961 | A | 4/1975 | Curry et al. | |
| 3,888,375 | A | 6/1975 | Gerk | |
| 4,385,706 | A | 5/1983 | Freeman | |
| 4,444,326 | A | 4/1984 | Musel | |
| 4,474,301 | A * | 10/1984 | Davis | 215/220 |
| 4,598,833 | A | 7/1986 | Herr | |
| 4,799,598 | A * | 1/1989 | McFadyen | 215/260 |
| 4,997,096 | A | 3/1991 | Kusz | |
| 5,280,842 | A | 1/1994 | Koo | |
| 5,839,603 | A * | 11/1998 | Smith et al. | 220/782 |
| 2008/0314900 | A1 | 12/2008 | Biesecker et al. | |
| 2009/0032486 | A1 | 2/2009 | Brozell et al. | |

FOREIGN PATENT DOCUMENTS

| | | |
|---|---|---|
| EP | 0090143 A1 | 10/1983 |
| GB | 1 529 999 | 10/1978 |

OTHER PUBLICATIONS

Annotated Figure 5 of US Pat. No. 3,817,416.*

* cited by examiner

*Primary Examiner* — Anthony Stashick
*Assistant Examiner* — James N Smalley
(74) *Attorney, Agent, or Firm* — Reising Ethington PC

(57) ABSTRACT

A plastic shell for a two-piece push-and-turn child-resistant closure in accordance with one aspect of the present disclosure includes a peripheral skirt, and a base wall from which the peripheral skirt depends. The base wall has a peripheral portion having a first thickness, a plurality of lugs disposed at least in part on the peripheral portion adjacent to the peripheral skirt, and a central portion having a second thickness less than the first thickness, and including a plurality of ribs having a third thickness greater than the second thickness and substantially equal to the first thickness and extending from the first peripheral portion toward a center of the base wall.

19 Claims, 4 Drawing Sheets

CHILD-RESISTANT CLOSURE SHELL, CLOSURE, AND PACKAGE

The present disclosure relates to closure shells for two-piece push-and-turn child-resistant closures, to closures that include such shells, and to packages that include such closures and shells.

BACKGROUND AND SUMMARY OF THE DISCLOSURE

U.S. Pat. No. 4,997,096 discloses a child-resistant closure having inner and outer plastic shells. The outer plastic shell has a base wall, a peripheral skirt and a circumferential array of lugs on an undersurface of the base wall. The inner plastic shell has a base wall, a peripheral skirt, at least one internal thread segment on the skirt, and a circumferential array of lugs on an outer surface of the base wall for opposed engagement by the internal lugs on the base wall of the outer shell. To remove the closure when it is threaded onto a container neck finish, the outer shell must be pushed axially against the inner shell and simultaneously rotated so that the lugs on the outer shell engage the lugs on the inner shell and rotate the inner shell with respect to the container neck finish. When the outer shell is rotated without applying an axial force to the outer shell, the lugs on the outer shell simply cam over the lugs on the inner shell and do not rotate the inner shell with respect to the container neck finish. Child-resistant closures of this type have been marketed for many years by applicants' assignee under the trademark ARGUS-LOC. See also GB 1529999. A general object of the present disclosure is to provide improvements in child-resistant closures of this type, and to provide packages that include such improved closures.

The present disclosure embodies a number of aspects that can be implemented separately from or in combination with each other.

A plastic shell for a two-piece push-and-turn child-resistant closure in accordance with one aspect of the present disclosure includes a peripheral skirt, and a base wall from which the peripheral skirt depends. The base wall has a peripheral portion having a first thickness, a plurality of lugs disposed at least in part on the peripheral portion adjacent to the peripheral skirt, and a central portion having a second thickness less than the first thickness. The central portion includes a plurality of ribs having a third thickness greater than the second thickness and substantially equal to the first thickness and extending from the first peripheral portion toward a center of the base wall.

A child-resistant closure in accordance with another aspect of the present disclosure includes a plastic outer shell having an outer base wall with an outer peripheral portion and an outer central portion disposed within the outer peripheral portion. The outer shell also has an outer peripheral skirt extending from the outer peripheral portion, and a plurality of internal lugs disposed at least in part on the outer peripheral portion. A plastic inner shell of the closure has an inner base wall with an inner peripheral portion and an inner central portion disposed within the inner peripheral portion. The inner shell also has an inner peripheral skirt extending from the inner peripheral portion, at least one internal thread segment on the inner peripheral skirt, and a plurality of external lugs disposed at least in part on the inner peripheral portion of the inner base wall adjacent to the inner peripheral skirt for engaging the internal lugs of the outer shell. At least one of the central portions of the base walls has an array of ribs substantially equal in thickness to its corresponding peripheral portion.

A child-resistant closure in accordance with a further aspect of the disclosure includes a plastic outer shell including an outer peripheral skirt, and an outer base wall from which the outer peripheral skirt depends and having a plurality of internal lugs adjacent to the outer peripheral skirt. A plastic inner shell of the closure is disposed within the outer shell and includes an inner peripheral skirt with at least one internal thread segment, and an inner base wall from which the inner peripheral skirt depends and having a plurality of external lugs adjacent to the inner peripheral skirt. The outer base wall of the outer shell has an outer peripheral portion of a first thickness on which the internal lugs are disposed, an outer central portion having a second thickness less than the first thickness and including an outer plurality of ribs having a third thickness greater than the second thickness and substantially equal to the first thickness and extending in a direction from the outer peripheral portion toward an outer center of the outer base wall. The inner base wall of the inner shell has an inner peripheral portion of a fourth thickness on which the external lugs are disposed, an inner central portion having a fifth thickness less than the fourth thickness and including an inner plurality of ribs having a sixth thickness greater than the fifth thickness and substantially equal to the fourth thickness and extending in a direction from the inner peripheral portion toward an inner center of the inner base wall.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
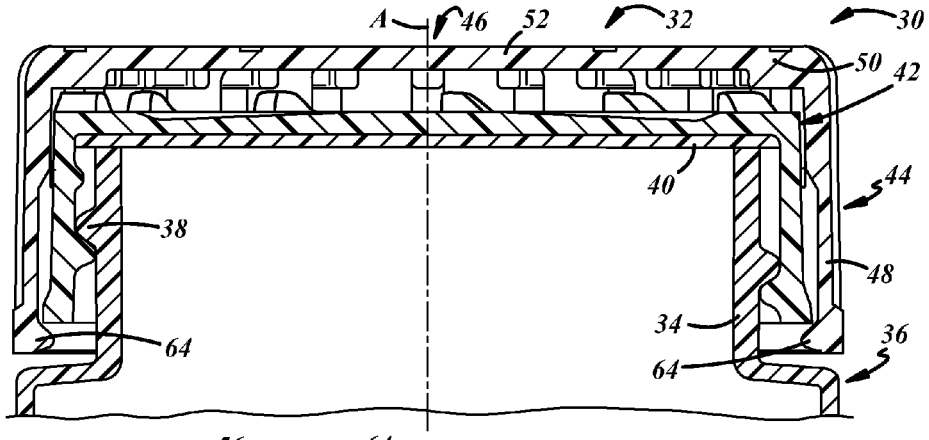
FIG. 1 is a fragmentary sectional view of a child-resistant package in accordance with an exemplary embodiment of the present disclosure.

FIG. 1 illustrates a child-resistant package 30 in accordance with an exemplary embodiment of the present disclosure as including a two-piece push-and-turn child-resistant closure 32 applied to a neck finish 34 of a container 36.

Container 36 can be of glass or plastic construction. Neck finish 34 is cylindrical and includes at least one external thread segment 38 to which closure 32 is applied. (The term "thread segment" is employed in its usual broad sense in this disclosure as including both single and multiple threads, and both continuous and discontinuous threads.) A foil seal 40 can be applied to the end surface of neck finish 34 to seal the package 30 during shipment and handling and/or to provide indication that the package 30 has not been opened. The child-resistant closure 32 includes a plastic inner shell 42 captured within a plastic outer shell 44.

Figure 2:
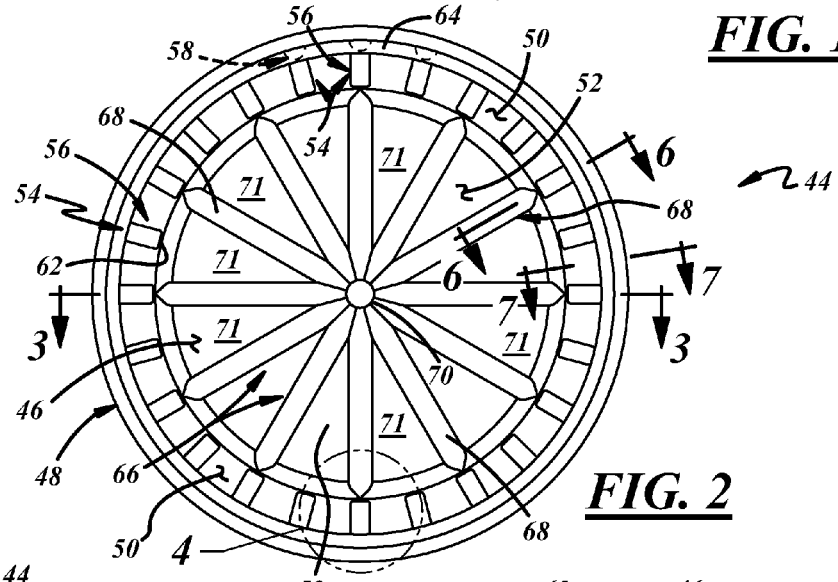
FIG. 2 is a bottom view of a plastic outer shell of a closure of the package of FIG. 1.
Figure 3:
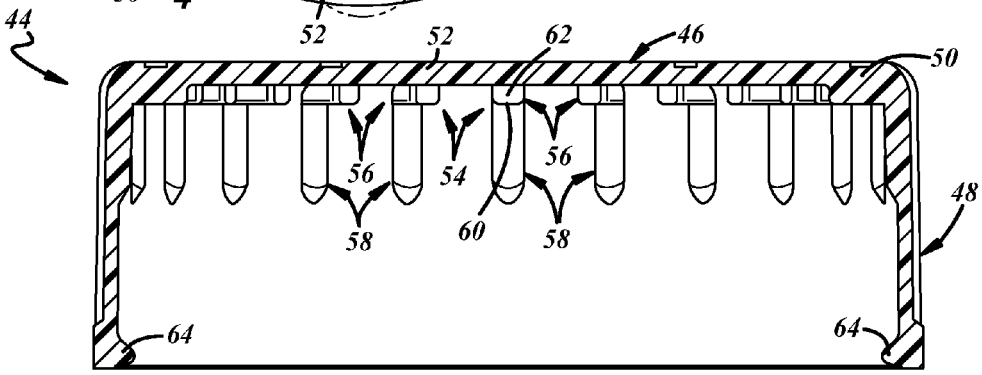
FIG. 3 is a sectional view taken substantially along line 3-3 in FIG. 2.
Figure 6:
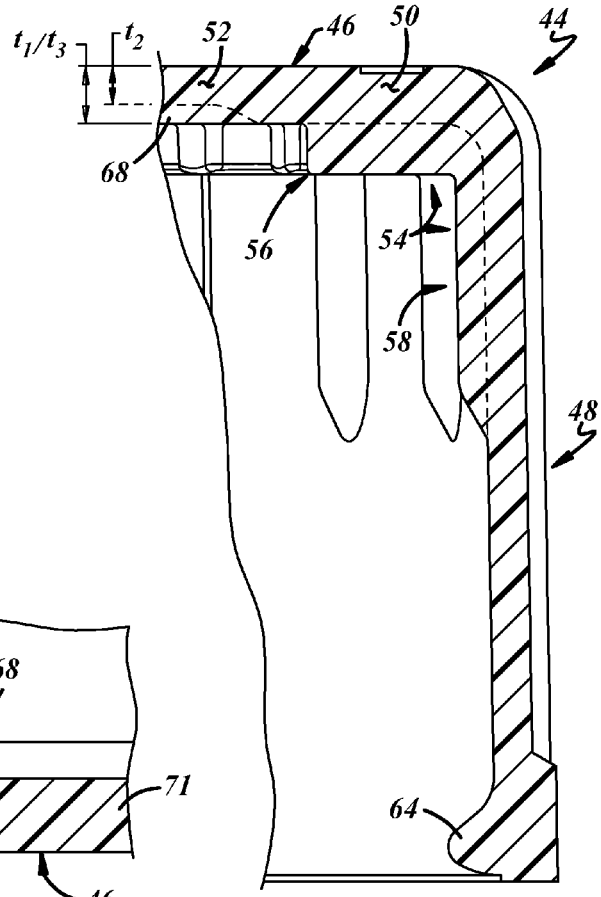
FIG. 6 is a fragmentary sectional view on an enlarged scale taken substantially along line 6-6 in FIG. 2.
Figure 7:
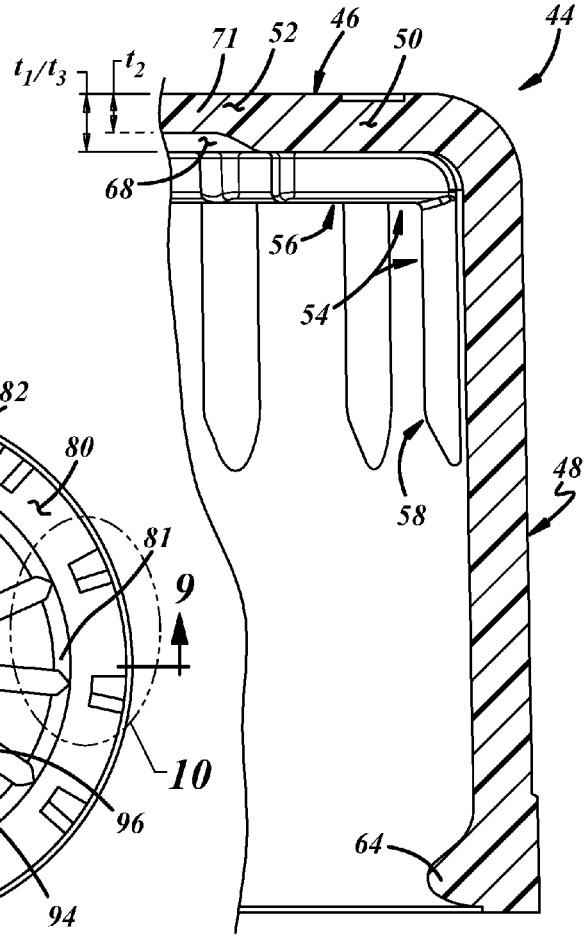
FIG. 7 is a fragmentary sectional view on an enlarged scale taken substantially along line 7-7 in FIG. 2.
Figure 10:
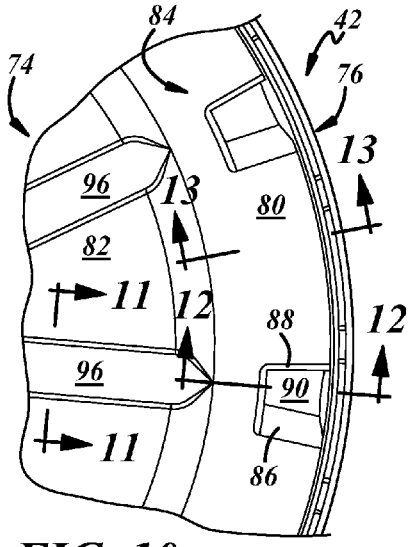
FIG. 10 is a fragmentary sectional view on an enlarged scale of a portion of FIG. 8 within oval 10.

Referring to FIGS. 2 and 3, the outer shell 44 includes a base wall 46 and a cylindrical peripheral skirt 48 depending from the base wall 46. As used herein, the term "peripheral" relates to a generally circumferential periphery. Referring to FIGS. 6 and 7, the base wall 46 preferably includes a peripheral portion 50 of a first thickness $t_1$ and a central portion 52 having a second thickness $t_2$ less than the first thickness of peripheral portion 50. As used herein, the term "thickness" relates to cross-sectional thickness in a direction parallel to a longitudinal closure axis A (FIG. 1). As shown in FIGS. 1-3, the central portion 52 of the outer shell 44 is disposed radially within the peripheral portion 50, and preferably is imperforate although at least part of the central portion 52 could be open in accordance with some aspects of the present disclosure. Indicia can be provided on an outer surface of the base wall 46 to instruct a user how to open the package.

Figure 4:
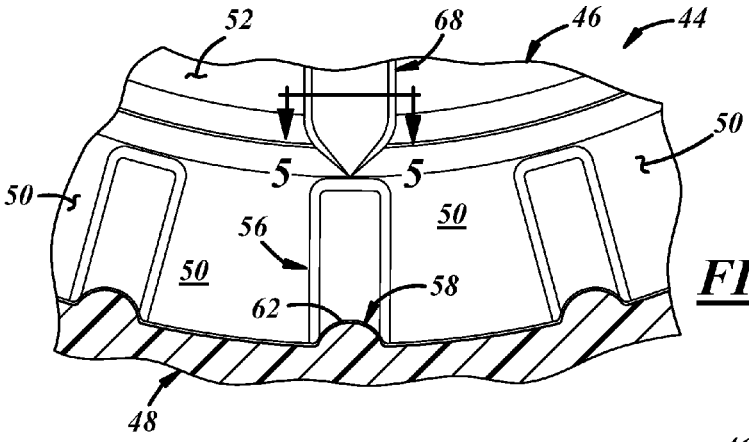
FIG. 4 is a fragmentary sectional view on an enlarged scale of a portion of FIG. 2 within circle 4.
Figure 5:
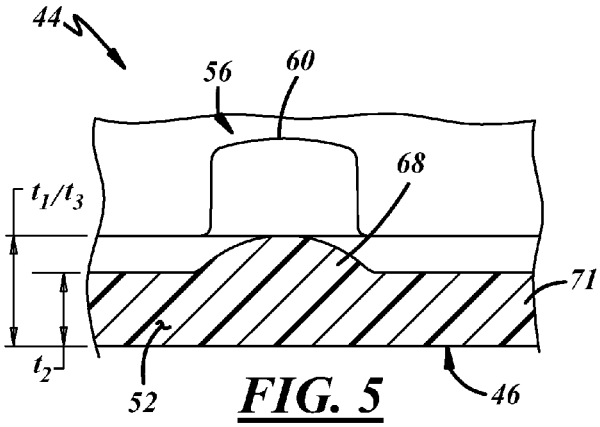
FIG. 5 is a fragmentary sectional view taken substantially along line 5-5 in FIG. 4.

Referring to FIGS. 2 and 3, a circumferential array of a plurality of angularly spaced internal lugs 54 are disposed around the periphery of base wall 46 adjacent to skirt 48. Also, although twenty-four lugs 54 are shown in FIG. 2, any suitable quantity of lugs 54 may be used. Each lug 54 preferably is L-shaped, having a first portion or leg 56 that extends radially inwardly along an undersurface of base wall 46. Referring to FIG. 3, each lug 54 also has a second portion or leg 58 that extends axially downwardly along a radially inside surface of skirt 48. As best seen in FIG. 5, undersurfaces 60 of legs 56 may be rounded and filleted. Also, as best seen in FIG. 4, radially inwardly facing surfaces 62 of legs 58 may be rounded. As shown in FIG. 1, there preferably is an internal bead 64 adjacent to the edge of skirt 48 remote from base wall 46 for capturing inner shell 42 within outer shell 44.

Referring to FIGS. 6 and 7, the central portion 52 of the outer shell 44 also has a third thickness $t_3$ that may be substantially equal to the first thickness $t_1$ of the peripheral portion 50. As used herein, the terminology "substantially equal" includes allowance for manufacturing tolerances, for example, +/−0.007" or +/−30% for wall thicknesses.

As shown in FIG. 2, the central portion 52 includes a rib array 66, which includes a plurality of ribs 68 disposed on an undersurface of the base wall 46, and may also include a hub 70 disposed on the undersurface. The hub 70 may correspond to an injection molding gate. The central portion 52 also includes a plurality of web portions 71 that extend between the ribs 68. The ribs 68 generally extend in a lateral direction from the peripheral portion 50 toward the central portion 52, wherein radially outer edges of one or more of the ribs 68 are contiguous with the peripheral portion 50. More specifically, the ribs 68 may be arranged in a spoke-like pattern and, thus, may extend in a radial direction from the peripheral portion 50 toward a center of the outer shell 44, or to the hub 70. However, the rib array 66 may be of any suitable shape and need not be symmetrical. Although twelve ribs 68 are shown, any suitable quantity of ribs may be used. In a preferred embodiment, however, and as shown in FIG. 3, there may be twice as many lugs 54 as ribs 68, and the ribs 68 may be generally radially aligned with corresponding lugs 54 and interspersed among every other one of the lugs 54.

Referring to FIGS. 6 and 7, the ribs 68 establish the third thickness $t_3$, and the plurality of web portions 71 extend between the ribs 68 and establish the second thickness $t_2$. As just one of many possible examples, the first and third thicknesses $t_1$, $t_3$ may be about 0.045 inches, and the second thickness $t_2$ may be about 0.030 inches, for a shell of approximately 1.720 inches in diameter and approximately 0.638 inches in height.

Figure 9:
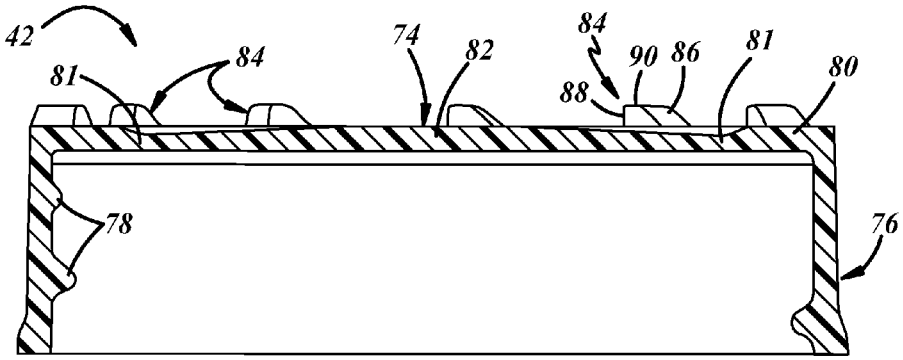
FIG. 9 is a sectional view taken substantially along line 9-9 in FIG. 8.
Figure 8:
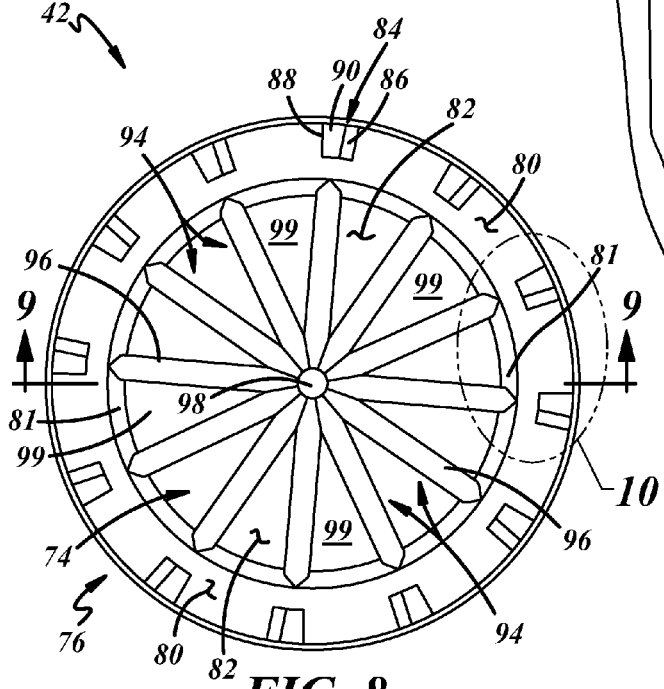
FIG. 8 is a top view of a plastic inner shell of the closure of the package of FIG. 1.
Figure 11:
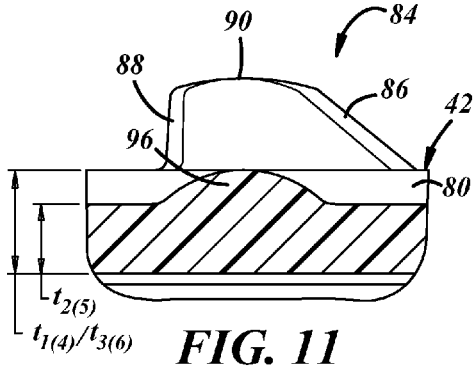
FIG. 11 is a fragmentary sectional view on an enlarged scale taken substantially along line 11-11 in FIG. 10.

Referring to FIGS. 8 and 9, the inner shell 42 includes a base wall 74 and a cylindrical peripheral skirt 76 depending from the base wall 74. Peripheral skirt 76 has one or more internal thread segments 78 for securing the closure to external thread segments 38 on container neck finish 34 (FIG. 1). Base wall 74 preferably has a peripheral portion 80 having a first (or fourth, when considering the outer shell thicknesses) thickness $t_{1(4)}$, and a central portion 82 having a second (or fifth) thickness $t_{2(5)}$, less than the first thickness $t_{1(4)}$ of peripheral portion 80. The central portion 82 is disposed radially within the peripheral portion 80, and preferably is imperforate although at least part of the central portion 82 could be open in accordance with some aspects of the present disclosure. A circumferential array of angularly spaced external lugs 84 is disposed around the periphery of base wall 74 adjacent to skirt 76. Each lug 84 has a clockwise-facing cam face 86 and a counterclockwise-facing abutment face 88. The upper or axially oriented faces 90 of lugs 84 preferably are rounded, as best seen in FIG. 11.

Figure 13:
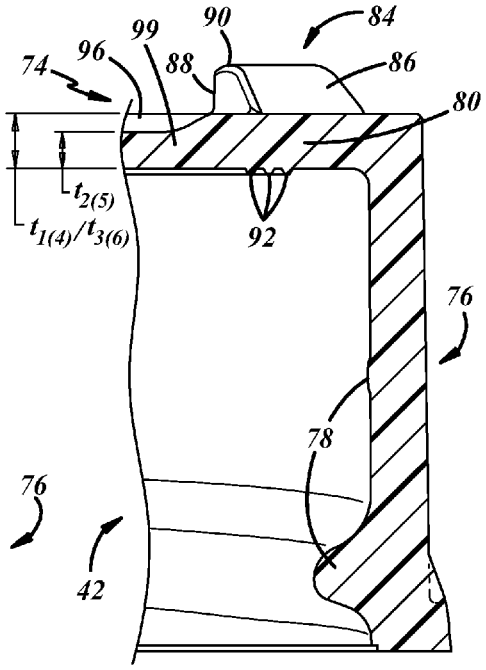
FIG. 13 is a fragmentary sectional view on an enlarged scale taken substantially along line 13-13 in FIG. 10.
Figure 12:
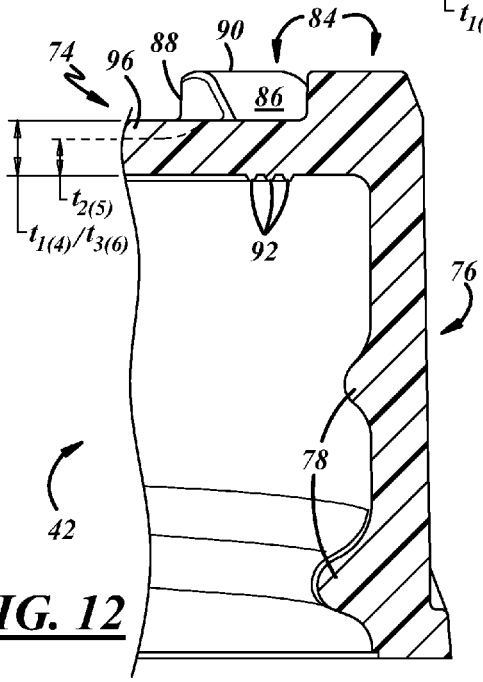
FIG. 12 is a fragmentary sectional view on an enlarged scale taken substantially along line 12-12 in FIG. 10.

Referring to FIGS. 12 and 13, the central portion 82 of the inner shell 42 also has a third (or sixth) thickness $t_{3(6)}$ that may be substantially equal to the first thickness $t_{1(4)}$ of the peripheral portion 80. Also, V-seals 92 can be provided on the undersurface of the peripheral portion 80 for sealing engagement with an end surface of the container neck finish 34 after removal of foil seal 40 (FIG. 1).

As shown in FIG. 8, the central portion 82 includes a rib array 94, which includes a plurality of ribs 96 disposed on a top surface of the base wall 74, and may also include a hub 98 disposed on the top surface. As used herein, directional words such as top, bottom, upper, lower, radial, circumferential, lateral, longitudinal, transverse, vertical, horizontal, and the like are employed by way of description and not limitation. The hub 98 may correspond to an injection molding gate. The central portion 82 also includes a plurality of web portions 99 that extend between the ribs 96. The ribs 96 generally extend in a lateral direction from the peripheral portion 80 toward the central portion 82, wherein radially outer edges of one or more of the ribs 96 are contiguous with the peripheral portion 80. More specifically, the ribs 96 may be arranged in a spoke-like pattern and, thus, may extend in a radial direction from the peripheral portion 80 to the center of the inner shell 42 or to the hub 98. In a preferred embodiment, however, and as shown in FIG. 8, there may be the same quantity of lugs 84 as there are ribs 96, and the ribs 96 may be generally radially aligned with the lugs 84.

Referring to FIGS. 12 and 13, the ribs 96 establish the third thickness $t_{3(6)}$, and the plurality of web portions 99 establish the second thickness $t_{2(5)}$. As just one of many possible examples, the first and third thicknesses $t_{1(4)}$, $t_{3(6)}$ may be about 0.045 inches, and the second thickness $t_{2(5)}$ may be about 0.030 inches, for a shell of approximately 1.580 inches in diameter and approximately 0.482 inches in height.

The ribs 68, 96 reduce sinking and/or doming of the central portions 52, 82 of the base walls 46, 74 as the relatively thicker peripheral portions 50, 80 tend to shrink more than the relatively thinner webs 71, 99 during cooling after molding.

The ribs 68, 96 also strengthen the base walls 46, 74 under load during use and improve material flow during molding.

The operation of the child-resistant closure 32 may be the same as or similar to that which is described in U.S. Patent Application Publication 2009/0032486, and which is assigned to the assignee hereof and is hereby incorporated by reference herein with the exception of paragraph 0031 thereof.

There thus has been disclosed a closure and a package that fully satisfy all of the objects and aims previously set forth. The disclosure has been presented in conjunction with an exemplary embodiment, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A plastic shell for a two-piece push-and-turn child-resistant closure that includes, a peripheral skirt, and a base wall from which said peripheral skirt depends, said base wall having:

a peripheral portion having a first thickness, a plurality of lugs disposed at least in part on said peripheral portion adjacent to said peripheral skirt, and a central portion having a second thickness less than said first thickness, and including a plurality of ribs separate from said lugs and having a third thickness greater than said second thickness and substantially equal to said first thickness and extending from said peripheral portion toward a center of said base wall, wherein said plurality of ribs is arranged in a spoke-like pattern, and said central portion also includes a plurality of webs extending between said plurality of ribs and establishing said second thickness, wherein ribs of said plurality of ribs are radially aligned with corresponding ones of said lugs so as to share common radial axes.

2. The plastic shell of claim 1 wherein radially outer edges of said plurality of ribs are contiguous with said peripheral portion of said base wall.

3. The plastic shell set forth in claim 1 wherein said plastic shell is an outer shell and said plurality of ribs is disposed on an undersurface of said base wall of said outer shell.

4. The plastic shell set forth in claim 1 wherein said central portion is imperforate and includes a hub to which said plurality of ribs extends from said peripheral portion.

5. A closure that includes a first one of the plastic shell as set forth in claim 1 as an outer shell of the closure and a second one of the plastic shell as set forth in claim 1 as an inner shell of the closure carried within the outer shell of the closure.

6. A child-resistant closure that includes:

a plastic outer shell having an outer base wall with an outer peripheral portion and an outer central portion disposed within said outer peripheral portion, an outer peripheral skirt extending from said outer peripheral portion, and a plurality of internal lugs disposed at least in part on said outer peripheral portion, and a plastic inner shell having an inner base wall with an inner peripheral portion and an inner central portion disposed within said inner peripheral portion, an inner peripheral skirt extending from said inner peripheral portion, at least one internal thread segment on said inner peripheral skirt and a plurality of external lugs disposed at least in part on said inner peripheral portion of said inner base wall adjacent to said inner peripheral skirt for engaging said internal lugs of said outer shell, and wherein said central portions of said base walls have less thickness than their corresponding peripheral portions and have arrays of ribs separate from said lugs substantially equal in thickness to their corresponding peripheral portions, and said central portions also include arrays of webs extending between said arrays of ribs and being thinner in transverse cross-sectional thickness than the corresponding peripheral portion, wherein ribs of said arrays of ribs are radially aligned with corresponding ones of said lugs so as to share common radial axes.

7. The closure set forth in claim 6 wherein at least one of said arrays of ribs is disposed on at least one of an undersurface of said outer base wall of said outer shell or a top surface of said inner base wall of said inner shell.

8. The closure set forth in claim 6 wherein radially outer edges of said arrays of ribs are contiguous with said peripheral portions of said base walls.

9. A package that includes a container having a neck finish and a closure as set forth in claim 5 and threaded onto said neck finish.

10. A child-resistant closure that includes:

a plastic outer shell including an outer peripheral skirt, and an outer base wall from which said outer peripheral skirt depends and having a plurality of internal lugs adjacent to said outer peripheral skirt, and a plastic inner shell disposed within said outer shell and including an inner peripheral skirt with at least one internal thread segment, and an inner base wall from which said inner peripheral skirt depends and having a plurality of external lugs adjacent to said inner peripheral skirt, said outer base wall of said outer shell having an outer peripheral portion of a first thickness on which said internal lugs are disposed, an outer central portion having a second thickness less than said first thickness and including an outer plurality of ribs separate from said internal lugs having a third thickness greater than said second thickness and substantially equal to said first thickness and extending in a direction from said outer peripheral portion toward an outer center of said outer base wall, said inner base wall of said inner shell having an inner peripheral portion of a fourth thickness on which said external lugs are disposed, an inner central portion having a fifth thickness less than said fourth thickness and including an inner plurality of ribs separate from said external lugs having a sixth thickness greater than said fifth thickness and substantially equal to said fourth thickness and extending in a direction from said inner peripheral portion toward an inner center of said inner base wall, wherein said central portions also include inner and outer pluralities of webs extending between said inner and outer pluralities of ribs and establishing said second and fifth thicknesses, wherein said inner and outer pluralities of ribs are radially aligned with corresponding ones of said internal and external lugs so as to share common radial axes.

11. The closure set forth in claim 10 wherein said outer plurality of ribs is disposed on an undersurface of said outer base wall of said outer shell, and said inner plurality of ribs is disposed on a top surface of said inner base wall of said inner shell.

12. The closure set forth in claim 10 wherein radially outer edges of said pluralities of ribs are contiguous with said peripheral portions of said base walls.

13. A package that includes a container having a neck finish, and a closure as set forth in claim 10 and threaded onto said neck finish.

14. A plastic shell for a two-piece push-and-turn child-resistant closure that includes, a peripheral skirt, and a base wall from which said peripheral skirt depends, said base wall having:

a peripheral portion having a first thickness, a plurality of lugs disposed at least in part on said peripheral portion adjacent to said peripheral skirt, and a central portion having a second thickness less than said first thickness, and including a plurality of ribs separate from said lugs and having a third thickness greater than said second thickness and substantially equal to said first thickness and extending from said first peripheral portion toward a center of said base wall, wherein said plastic shell is an inner shell and said plurality of ribs is disposed on a top surface of said base wall of said inner shell, and said central portion also includes a plurality of webs extending between said plurality of ribs and establishing said second thickness, wherein ribs of said plurality of ribs are radially aligned with corresponding ones of said lugs so as to share common radial axes.

15. A child-resistant closure that includes:

a plastic outer shell having an outer base wall with an outer peripheral portion and an outer central portion disposed within said outer peripheral portion, an outer peripheral skirt extending from said outer peripheral portion, and a plurality of internal lugs disposed at least in part on said outer peripheral portion, and a plastic inner shell having an inner base wall with an inner peripheral portion and an inner central portion disposed within said inner peripheral portion, an inner peripheral skirt extending from said inner peripheral portion, at least one internal thread segment on said inner peripheral skirt and a plurality of external lugs disposed at least in part on said inner peripheral portion of said inner base wall adjacent to said inner peripheral skirt for engaging said internal lugs of said outer shell, wherein said central portions of said base walls have less thickness than their corresponding peripheral portions and have arrays of ribs separate from said lugs substantially equal in thickness to their corresponding peripheral portions, and there are twice as many of said internal lugs as there are of said ribs of said outer shell, said ribs of said outer shell being interspersed among every other one of said internal lugs and generally radially aligned with corresponding ones of said internal lugs, and said ribs of said inner shell being generally radially aligned with corresponding ones of said external lugs and the quantity of external lugs is the same as the quantity of ribs of said inner shell.

16. The plastic shell of claim 1 wherein said webs are circumferentially wider than said ribs and said lugs are L-shaped, having first legs extending radially inwardly along an undersurface of said base wall and second legs extending axially downwardly along a radially inside surface of said skirt.

17. The child-resistant closure of claim 6 wherein said webs are circumferentially wider than said ribs and said internal lugs of said outer shell are L-shaped, having first legs extending radially inwardly along an undersurface of said base wall and second legs extending axially downwardly along a radially inside surface of said skirt.

18. The child-resistant closure of claim 10 wherein said webs are circumferentially wider than said ribs and said internal lugs of said outer shell are L-shaped, having first legs extending radially inwardly along an undersurface of said base wall and second legs extending axially downwardly along a radially inside surface of said skirt.

19. The plastic shell of claim 14 wherein said webs are circumferentially wider than said ribs and said lugs are L-shaped, having first legs extending radially inwardly along an undersurface of said base wall and second legs extending axially downwardly along a radially inside surface of said skirt.

* * * * *